US007335048B1

(12) United States Patent
Chen et al.

(10) Patent No.: US 7,335,048 B1
(45) Date of Patent: Feb. 26, 2008

(54) ELECTRICAL CONNECTOR HAVING LATCHING MECHANISM

(75) Inventors: Hung-Chuan Chen, Taoyuan Hsien (TW); Szu-Lu Huang, Taoyuan Hsien (TW); Hung-Chang Hsieh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/534,122

(22) Filed: Sep. 21, 2006

(30) Foreign Application Priority Data

Aug. 2, 2006 (TW) ..... 95128368 A

(51) Int. Cl.
*H01R 13/627* (2006.01)

(52) U.S. Cl. ..... 439/358

(58) Field of Classification Search ..... 439/353, 439/354, 358, 357
See application file for complete search history.

(56) References Cited

U.S. PATENT DOCUMENTS 6,830,472 B1 * 12/2004 Wu ..... 439/358
6,945,807 B1 * 9/2005 Wu ..... 439/354
2004/0147170 A1 * 7/2004 Greenwood et al. ..... 439/696

* cited by examiner

*Primary Examiner*—Ross Gushi
(74) *Attorney, Agent, or Firm*—Kirton & McConkie; Evan R. Witt

(57) ABSTRACT

An electrical connector includes a plurality of pins, an isolation body and a latching mechanism. The isolation body has a specified side including a first portion, a second portion and an indentation. The second portion is higher than the first portion. The indentation is formed in the first portion and the second portion. The latching mechanism has an end fixed onto the second portion and extended above a bottom surface of the indentation, wherein the latching mechanism includes at least a fastening part.

17 Claims, 4 Drawing Sheets

ELECTRICAL CONNECTOR HAVING LATCHING MECHANISM

FIELD OF THE INVENTION

The present invention relates to an electrical connector, and more particularly to an electrical connector having a latching mechanism.

BACKGROUND OF THE INVENTION

Electrical connectors are widely used in most electrical appliance for making electrical connection between two electronics components or two electrical appliances. For example, a so-called serial advanced technology attachment (SATA) connector is mounted on a cable end of an electrical appliance such as a hard disc, a computer peripheral storage device or a power supply apparatus. Via such a connector, this electrical appliance can be electrically connected to another electronic appliance such as a host computer.

Referring to FIG. 1, a schematic perspective view of a conventional electrical connector is illustrated. The electrical connector 1 of FIG. 1 includes an isolation body 10, a sheltering body 11 and a plurality of pins 12. The electrical connector 1 is mounted on the cable end of an electrical appliance to be coupled with corresponding electrical connector of another electrical appliance so as to make electrical connection between these two electrical appliances. The isolation body 10 is detachably coupled to the sheltering body 11, and a channel 14 is defined therewithin. The plurality of pins 12 are received within the channel 14 and have first ends coupled to cables 13. The second ends of the pins 12 are exposed to the entrance 15 of the channel 14 to be coupled with corresponding pins of the electrical connector of another electrical appliance.

Please refer to FIG. 1 again. The electrical connector 1 further includes a latching mechanism 16 on the upper side 10*a* of the isolation body 10. The latching mechanism 16 includes a connecting part 16*a*, a suppressing part 16*b* and at least a fastening part 16*c*.

The connecting part 16*a* of the latching mechanism 16 has a front end fixed on the upper side 10*a* and in the vicinity of the periphery of the entrance 15. The connecting part 16*a* is substantially a slant ascending toward the rear side thereof. The sheltering body 11 has a hollow portion 17 corresponding to the latching mechanism 16. In response to a depressing force exerted on the suppressing part 16*b*, the suppressing part 16*b* is partially received in the hollow portion 17. In addition, two stopping blocks 18 are protruded from the upper side 10*a* of the isolation body 10, and a raised block 19 is protruded from the upper side 11*a* of the sheltering body 11. For combining the isolation body 10 with the sheltering body 11, the isolation body 10 is inserted into the channel portion of the sheltering body 11 and then the stopping blocks 18 are penetrated through the hollow portion 17. Under this circumstance, the isolation body 10 is securely engaged with the sheltering body 11 by the stopping blocks 18, and the latching mechanism 16 is located in the vicinity of the raised block 19. Since the latching mechanism 16 is partially enclosed by the stopping blocks 18 and the raised block 19, the latching mechanism 16 is protected from being damaged or erroneously touched by the foreign components.

The fastening parts 16*c* of the latching mechanism 16 are arranged on the connecting part 16*a*. Once the electrical connector 1 is coupled with corresponding electrical connector (not shown) of another electrical appliance, the fastening parts 16*c* are engaged with the fastening parts (not shown) of the corresponding electrical connector so as to enhance secure attachment between these two electrical connectors. For coupling these two electrical connectors, a depressing force is exerted on the suppressing part 16*b* of the latching mechanism 16 such that the fastening part 16*c* is slightly lowered to be engaged with the fastening parts (not shown) of the corresponding electrical connector to enhance secure attachment between these two electrical connectors. Whereas, for detaching these two electrical connectors from each other, a depressing force is exerted on the suppressing part 16*b* of the latching mechanism 16, such that the fastening parts 16*c* are slightly lowered to be disengaged from the fastening parts (not shown) of the corresponding electrical connector.

The structure of the electrical connector 1 still has some drawbacks. For example, the process of assembling the isolation body 10 and the sheltering body 11 is complicated. As shown in FIG. 1, the front end of the latching mechanism 16 is fixed on the upper side 10*a* in the vicinity of the periphery of the entrance 15 and ascends toward the rear side thereof. In addition, the fastening parts 16*c* of the latching mechanism 16 are arranged on the connecting part 16*a* and proximate the front end of connecting part 16*a*. Therefore, the shift amount of the fastening parts 16*c* is small in response to the external force exerted on the suppressing part 16*b*. In other words, it is laborious to lower the fastening parts 16*c* in order to couple or detach these two electrical connectors. Moreover, the stopping blocks 18 and the raised block 19 increase structural and assembling complexity.

In views of the above-described disadvantages resulted from the conventional method, the applicant keeps on carving unflaggingly to develop an electrical connector having a latching mechanism according to the present invention through wholehearted experience and research.

SUMMARY OF THE INVENTION

It is an object of the present invention to provide an electrical connector having a latching mechanism to be mounted on the cable end of an electrical appliance in order to be electrically connected to corresponding electrical connector of another electronic appliance.

It is another object of the present invention to provide an electrical connector, which is simple in structure and easily assembled.

It is another object of the present invention to provide an electrical connector having a latching mechanism for facilitating easy attachment and detachment of the electric connector and a corresponding electrical connector.

In accordance with an aspect of the present invention, there is provided an electrical connector. The electrical connector includes a plurality of pins, an isolation body and a latching mechanism. The isolation body has a specified side including a first portion, a second portion and an indentation. The second portion is higher than the first portion. The indentation is formed in the first portion and the second portion. The latching mechanism has an end fixed onto the second portion and extended above a bottom surface of the indentation, wherein the latching mechanism includes at least a fastening part.

In accordance with another aspect of the present invention, there is provided an electrical connector, which is mounted on a cable end of an electrical appliance. The electrical connector includes a plurality of pins, an isolation body and a latching mechanism. The pins have first ends coupled to the cable end. The isolation body has a specified side including a first portion, a second portion and an indentation. The second portion is higher than the first portion. The indentation is formed in the first portion and the second portion. The latching mechanism has an end fixed onto the second portion and extended above a bottom surface of the indentation, wherein the latching mechanism includes at least a fastening part.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
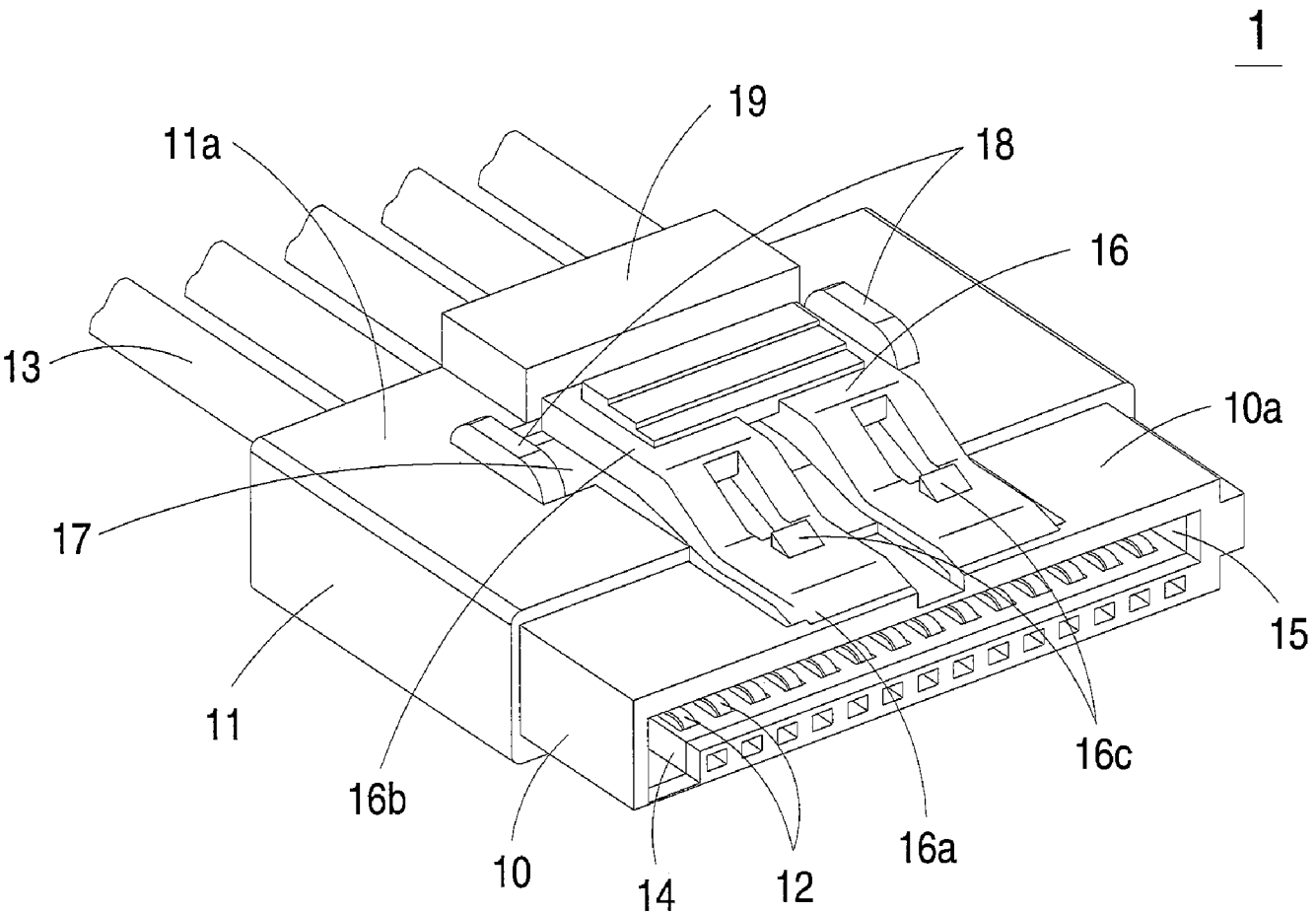
Fig. 1 prior art
FIG. 1 is a schematic perspective view of a conventional electrical connector.
Figure 2:
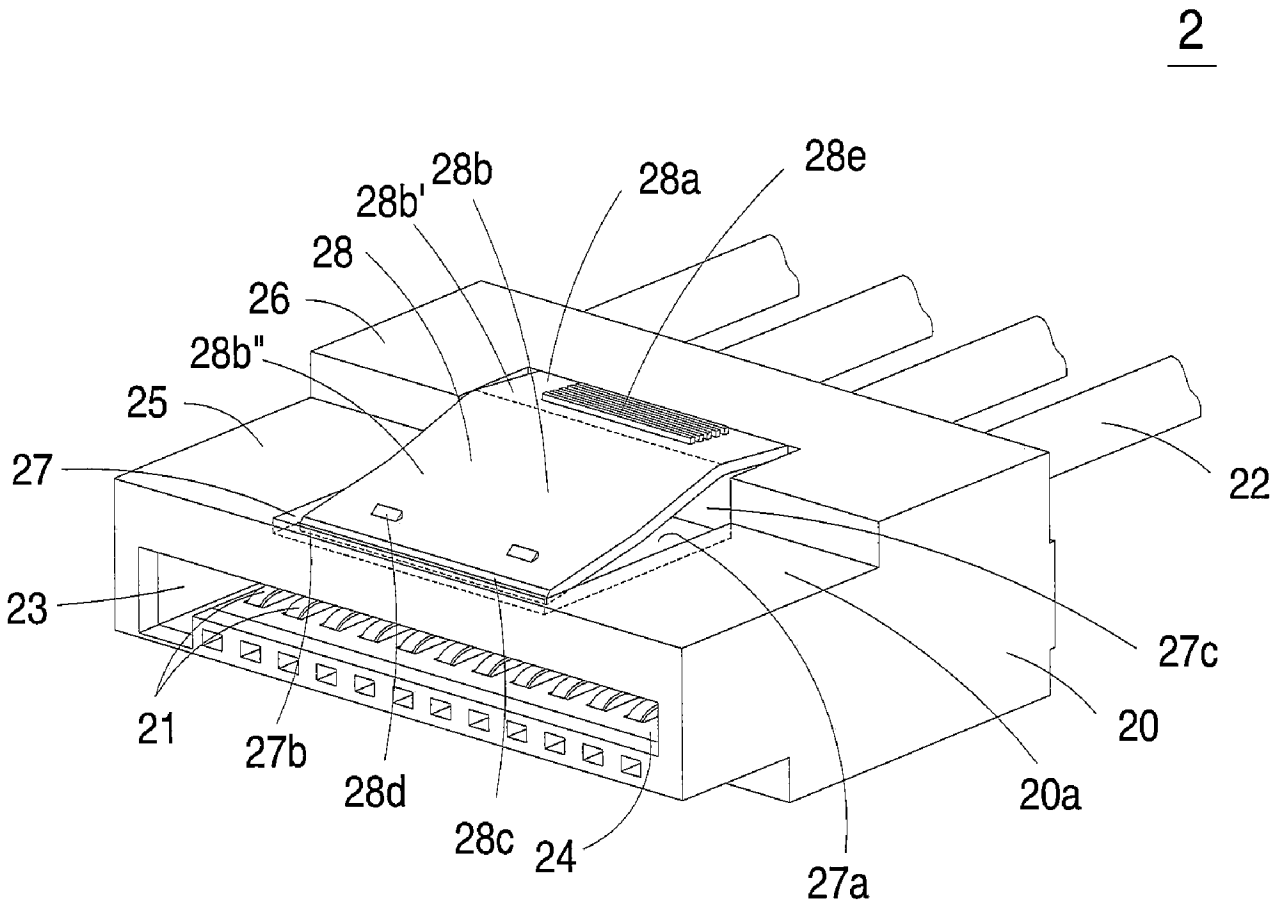
FIG. 2 is a schematic perspective view of an electrical connector having a latching mechanism according to a preferred embodiment of the present invention.

Referring to FIG. 2, a schematic perspective view of an electrical connector having a latching mechanism according to a preferred embodiment of the present invention is illustrated. The electrical connector 2 of FIG. 2 includes an isolation body 20 and a plurality of pins 21. The electrical connector 2 is mounted on the cable end 22 of an electrical appliance such as a hard disc, a computer peripheral storage device or a power supply apparatus. Via this connector 2, this electrical appliance can be electrically connected to corresponding electrical connector (not shown) of another electronic appliance such as a host computer.

Please refer to FIG. 2 again. A channel 23 is defined within the isolation body 20. The plurality of pins 21 are received within the channel 23. The pins 21 have first ends coupled to cables 22. The second ends of the pins 21 are exposed to the entrance 24 of the channel 23 to be coupled with corresponding pins (not shown) of the electrical connector of another electrical appliance. The upper side 20*a* of the isolation body 20 includes a first upper side portion 25 and a second upper side portion 26. The second upper side portion 26 has a higher level than the first upper side portion 25 relative to the bottom of the isolation body 20. An indentation 27 is formed in middles of the first upper side portion 25 and the second upper side portion 26. The indentation 27 is separated from the channel 23 by a partition part (not shown). The bottom surface 27*a* of the indentation 27 is lower than the surface of the first upper side portion 25. The indentation 27 further has a first sidewall 27*b* proximate the entrance 24 of the channel 23 and a second sidewall 27*c* in the second upper side portion 26.

Please refer to FIG. 2 again. The electrical connector 2 further includes a latching mechanism 28 arranged on the isolation body 20. The rear end of the latching mechanism 28 is fixed on the second upper side portion 26 of the isolation body 20. In some embodiments, the latching mechanism 28 is integrally mounted onto the second upper side portion 26 of the isolation body 20. The latching mechanism 28 includes a connecting part 28*a*, a tilt part 28*b*, a free end part 28*c* and at least a fastening part 28*d*. The connecting part 28*a* of the latching mechanism 28 is fixed onto the second sidewall 27*c* of the indentation 27. Especially, the connecting part 28*a* is fixed onto the upper edge of the second sidewall 27*c*. The tilt part 28*b* of the latching mechanism 28 is connected to the connecting part 28*a* and extended above the bottom surface 27*a* of the indentation 27. In some embodiments, the tilt part 28*b* of the latching mechanism 28 includes a first tilt segment 28*b*' and a second tilt segment 28*b*". The first tilt segment 28*b*' of the tilt part 28*b* is connected to the connecting part 28*a* and extended upwardly such that at least a portion of the first tilt segment 28*b*' is higher than the second upper side portion 26. The second tilt segment 28*b*" of the tilt part 28*b* is arranged between the first tilt segment 28*b*' and the free end part 28*c*, and extended downwardly toward the free end part 28*c*. The free end part 28*c* is substantially received within the indentation 27 and in contact with or close to the bottom surface 27*a* of the indentation 27. It is noted that, however, those skilled in the art will readily observe that numerous modifications and alterations of the tilt part 28*b* of the latching mechanism 28 may be made while retaining the teachings of the invention. For example, the tilt part 28*b* may include more than three tilt segments. Alternatively, there is a gap between the free end part 28*c* of the latching mechanism 28 and the first sidewall 27*b* of the indentation 27.

As shown in FIG. 2, the fastening part 28*d* is arranged on the tilt part 28*b* and proximate the free end part 28*c*. An exemplary fastening part 28*d* is a fastening block. If no external force is exerted on the latching mechanism 28, the fastening part 28*d* is slightly higher than the first upper side portion 25.

Figure 3:
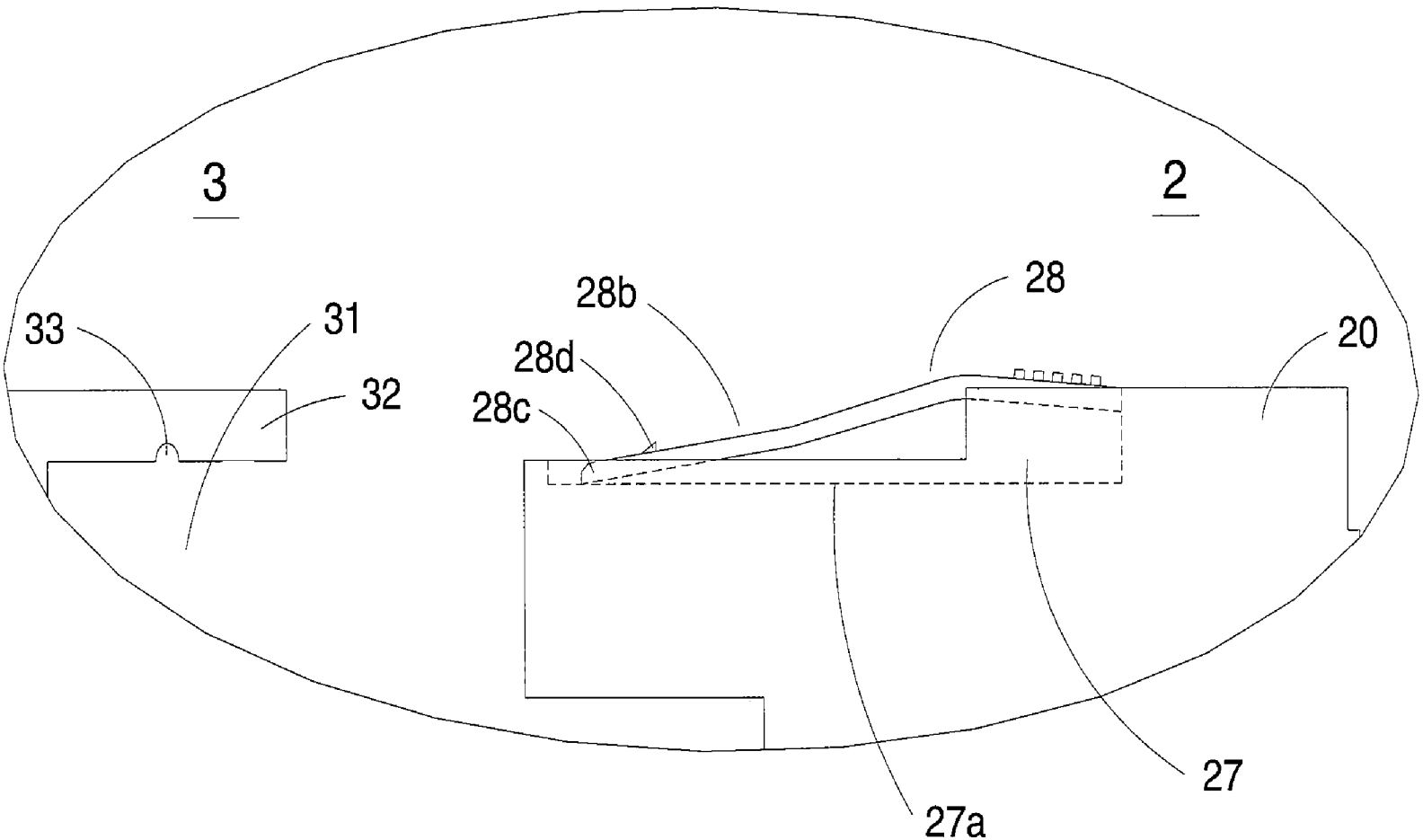
FIG. 3 is a partially schematic cross-sectional view illustrating the electrical connector 2 to be coupled with another electrical connector 3.

Please refer to FIG. 3, which is a partially schematic cross-sectional view illustrating the electrical connector 2 to be coupled with another electrical connector 3. The electrical connector 3 has an entrance 31. An edge portion 32 of the entrance 31 has a fastening part 33 corresponding to the fastening part 28*d* of the latching mechanism 28 of the electrical connector 2. An exemplary fastening part 33 is a fastening recess.

A process of coupling the electrical connector 2 with the electrical connector 3 will be illustrated as follows. First of all, the electrical connector 3 is pushed toward the electrical connector 2 such that the edge portion 32 of the entrance 31 is sustained against the fastening part 28*d* and/or the tilt part 28*b* of the latching mechanism 28 of the electrical connector 2. As the edge portion 32 of the entrance 31 is advanced, the tilt part 28*b* is lowered such that the free end part 28*c* of the latching mechanism 28 is in contact with the bottom surface 27*a* of the indentation 27. Next, as the edge portion 32 of the entrance 31 is further advanced, the fastening part 33 is engaged with the fastening part 28*d* of the latching mechanism 28. Under this circumstance, a secure attachment and an electrical connection between the electrical connector 2 and the electrical connector 3 are rendered. From the above description, since the fastening part 28*d* and/or the tilt part 28*b* are deformed during these two electrical connectors are coupled with each other, no extra external force is required to be exerted on the latching mechanism 28.

Hereinafter, a process of detaching the electrical connector 2 from the electrical connector 3 will be illustrated as follows with reference to also FIG. 2 and FIG. 3. First of all, in response to an external force exerted on the first tilt segment 28*b*' of the tilt part 28*b*, the free end part 28*c* of the latching mechanism 28 is in contact with the bottom surface 27*a* of the indentation 27 and advanced toward the first sidewall 27*b* of the indentation 27. Under this circumstance, the fastening part 28*d* of the latching mechanism 28 is disengaged from the fastening part 33 of the electrical connector 3 such that these two electrical connectors 2 and 3 will be detached from each other. In some embodiments, the fastening part 28*d* has an inclined surface for facilitating engagement or disengagement of the fastening part 28*d* and the fastening part 33.

Optionally, the latching mechanism 28 further includes a suppressing part 28*e* arranged on the first tilt segment 28*b*' of the tilt part 28*b*. The suppressing part 28*e* may facilitate the user to recognize a proper position of exerting the external force for detaching these two electrical connectors. In addition, the surface of the suppressing part 28*e* is preferably made rough in order to facilitate the user to exert the external force.

Figure 4:
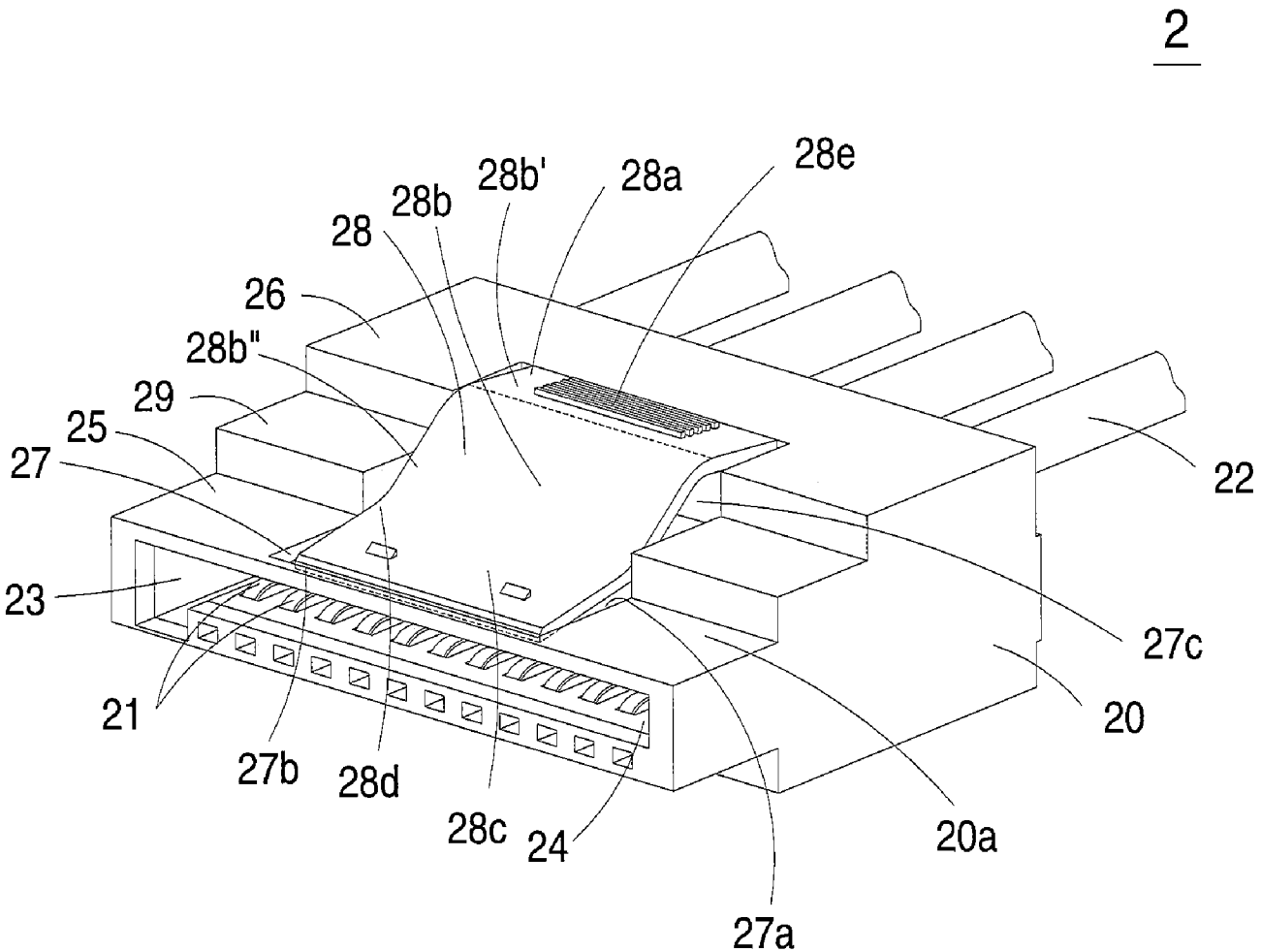
FIG. 4 is a schematic perspective view of an electrical connector having a latching mechanism according to another preferred embodiment of the present invention.

A further embodiment of an electrical connector having a latching mechanism is illustrated in FIG. 4. In this embodiment, the pins 21, the cables 22 and the latching mechanism 28 are included therein are similar to those shown in FIG. 2, and are not redundantly described herein. In addition, the isolation body 20 further includes a third upper side portion 29 between the first upper side portion 25 and the second upper side portion 26. The third upper side portion 29 has a higher level than the first upper side portion 25 relative to the bottom of the isolation body 20. The second upper side portion 26 is higher than the third upper side portion 29. An indentation 27 is formed in middles of the first upper side portion 25, the third upper side portion 29 and the second upper side portion 26.

From the above description, the electrical connector of the present invention can be mounted on the cable end of an electrical appliance in order to be electrically connected to corresponding electrical connector of another electronic appliance. In comparison with the prior art, the electrical connector of the present invention is simple in structure and easily assembled. The special design of the latching mechanism 28 facilitates easy attachment and detachment of the electric connector 2 and a corresponding electrical connector. Moreover, the latching mechanism 28 is partially enclosed by the indentation 27, which is defined by the bottom surface 27*a*, the first sidewall 27*b* and the second sidewall 27*c*. As a consequence, the latching mechanism 28 is protected from being damaged or erroneously touched by the foreign components without the use of the stopping blocks and the raised block.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical connector comprising:

a plurality of pins;

an isolation body being unitarily constructed and having a specified side including a first portion, a second portion and an indentation, said second portion being higher than said first portion, and said indentation being formed in said first portion and said second portion and having a first sidewall and a second sidewall, said second sidewall being in said second portion; and a latching mechanism having a connecting part fixed onto said second sidewall of said indentation, a tilt part connected to said connecting part and extended above a bottom surface of said indentation, and a free end part connected to said tilt part and in contact with said bottom surface of said indentation, said tilt part further comprising a first tilt segment and a second tilt segment, said first tilt segment connected to said connecting part and extended upwardly such that at least a portion of said first tilt segment is higher than said second portion, and said second tilt segment arranged between said first tilt segment and said free end part, and extended downwardly toward said free end part, wherein said latching mechanism is unitarily constructed with said isolation body and includes at least a fastening part.

2. The electrical connector according to claim 1 wherein said specific side is the upper side of said isolation body, and said indentation is formed in the middles of said first portion and said second portion.

3. The electrical connector according to claim 1 wherein said connecting part is fixed onto an upper edge of said second portion of said isolation body.

4. The electrical connector according to claim 1 wherein said latching mechanism further comprises a suppressing part arranged on said first segment of said tilt part.

5. The electrical connector according to claim 1 wherein there is a gap between said free end part of said latching mechanism and said first sidewall of said indentation.

6. The electrical connector according to claim 1 wherein said fastening part is a fastening block with an inclined surface.

7. The electrical connector according to claim 1 wherein a channel is defined within said isolation body, and said pins are received within the channel.

8. The electrical connector according to claim 7 wherein said pins have first ends coupled to cables and second ends exposed to an entrance of said channel, and said isolation body are mounted on ends of said cables.

9. The electrical connector according to claim 7 wherein said bottom surface of said indentation is lower than the upper surface of said first portion, and said first sidewall is proximate said entrance of said channel, wherein said first sidewall is opposed to said second sidewall.

10. The electrical connector according to claim 1 wherein said fastening part is arranged on said tilt part proximate said free end part.

11. The electrical connector according to claim 10 wherein said fastening part is slightly higher than said first portion of said isolation body.

12. The electrical connector according to claim 1 wherein said isolation body further includes a third portion arranged between said first portion and said second portion, said third portion being higher than said first portion but lower than said second portion.

13. The electrical connector according to claim 12 wherein said indentation being formed in the middles of said first portion, said second portion and said third portion of said isolation body.

14. An electrical connector mounted on a cable end of an electrical appliance, said electrical connector comprising:

a plurality of pins having first ends coupled to said cable end;

an isolation body being unitarily constructed and having a specified side including a first portion, a second portion and an indentation, said second portion being higher than said first portion, and said indentation being formed in said first portion and said second portion and having a first sidewall and a second sidewall, said second sidewall being in said second portion; and a latching mechanism having a connecting part fixed onto said second sidewall of said indentation, a tilt part connected to said connecting part and extended above a bottom surface of said indentation, and a free end part connected to said tilt part and in contact with said bottom surface of said indentation, said tilt part further comprising a first tilt segment and a second tilt segment, said first tilt segment connected to said connecting part and extended upwardly such that at least a portion of said first tilt segment is higher than said second portion, and said second tilt segment arranged between said first tilt segment and said free end part, and extended downwardly toward said free end part, wherein said latching mechanism is unitarily constructed with said isolation body and includes at least a fastening part.

15. The electrical connector according to claim 14 wherein a channel is defined within said isolation body, said pins are received within the channel, and said pins have second ends exposed to an entrance of said channel.

16. The electrical connector according to claim 14 wherein said specific side is the upper side of said isolation body, and said indentation is formed in the middles of said first portion and said second portion.

17. The electrical connector according to claim 14 wherein said fastening part is arranged on said tilt part proximate said free end part; and a suppressing part arranged on said first tilt segment of said tilt part.

* * * * *